US005172137A

United States Patent [19]

Hongo et al.

[11] Patent Number: 5,172,137

[45] Date of Patent: Dec. 15, 1992

[54] THERMAL PRINTER

[75] Inventors: Takayasu Hongo; Setsuo Sasabe; Kenichi Fujii; Eiji Hirao; Kazuya Beesho, all of Hyogo, Japan

[73] Assignee: Kanzaki Paper Manufacturing Co., Ltd., Tokyo, Japan

[21] Appl. No.: 797,901

[22] Filed: Nov. 26, 1991

[30] Foreign Application Priority Data

Nov. 30, 1990 [JP] Japan ..... 2-129216[U]
Nov. 30, 1990 [JP] Japan ..... 2-340431

[51] Int. Cl.[5] ..... B41J 25/312

[52] U.S. Cl. ..... 346/76 PH; 400/120; 400/55; 400/231

[58] Field of Search ..... 400/231, 120, 120 HE, 400/55, 56, 57; 346/76 PH

[56] References Cited

U.S. PATENT DOCUMENTS 4,524,715 6/1985 Abrams ..... 118/221

FOREIGN PATENT DOCUMENTS 0053066 3/1986 Japan ..... 400/120
0080064 4/1987 Japan ..... 400/120
0282947 12/1987 Japan ..... 346/76 PH

*Primary Examiner*—Benjamin R. Fuller
*Assistant Examiner*—Huan Tran
*Attorney, Agent, or Firm*—Cushman, Darby & Cushman

[57] ABSTRACT

A thermal head in a thermal printer is biased by a plurality of springs which are provided between the thermal head and stopper of the movable shafts, respectively. The distances between the thermal head and the stoppers are commonly adjusted by a rotating shaft through gears fixed to the rotating shaft and worms formed on the movable shafts, thereby subtly adjusting the thermal head biasing force of the springs in accordance with the condition of a sheet to be used.

6 Claims, 3 Drawing Sheets

THERMAL PRINTER

BACKGROUND OF THE INVENTION

1. Field of the Invention

The invention relates to a thermal printer having biasing force adjustment means by which the force for biasing a thermal head onto a platen roll can be adjusted easily without recourse to any special skill.

2. Description of Prior Art

Conventionally, the printing methods of a thermal printer generally is of two types. The first time is a serial printer, in which a printing is made on a sheet while moving a thermal head in a print width direction. The other is a line printer in which a printing is made on a sheet using a fixed line thermal head having a heating body corresponding to all dots in the print width direction.

In printers of the above types, the quality of the print by the thermal head is greatly affected by consistency in the force for biasing the thermal head onto the platen roll.

Thus, biasing force adjustment means is provided to adjust and maintain a constant thermal head biasing force.

Such biasing force adjusting means includes male screw portions provided at front end portions of cylindrical movable shafts with are screwed into female screw-like holes, the holes being usually provided at two locations in a base board. The other ends of the movable shafts have stoppers, and springs are arranged between the stoppers and the thermal head not only to bias the thermal head by their restoring forces, but also to adjust the amount by which the movable shafts slide from the base board so that the force for biasing the thermal head onto the platen roll is maintained.

Since the conventional thermal printer is so constructed as to adjust the thermal head biasing force as described above, the adjusting operation, must be performed by a highly skilled person and has seldom been performed by the user.

Thus, the serviceman must visit the user's premises and provide the above adjustment. This process is inefficient and imposes a comparatively large burden on the same provider and the consumer his part.

In addition, when print sheets of different thickness are used or when sheets of different surface smoothness are used, the thermal head biasing force must be adjusted subtly in accordance with their conditions. However, as described above, the adjustment demands an extremely high degree of skill and thus is seldom performed at the user's premises. Moreover, in the case where sheets of different thickness or different surface smoothness are used or in a like case, the printer is used without subtly adjusting, of the thermal head biasing force in accordance with their conditions. As a result, the thermal printers produce poor-quality printed sheets.

SUMMARY OF THE INVENTION

An object of the invention is to provide a thermal printer having biasing force adjusting means that can adjust the biasing force easily without recourse to any special skill.

In order to attain the above-noted and other objects, the present invention provides a thermal printer for printing print data on a sheet using a thermal head, comprising: a plurality of biasing means, disposed in a print width direction, for biasing the thermal head onto a platen roll; and adjustment means for commonly adjusting the plurality of biasing means.

The adjustment means for commonly adjusting the plurality of biasing means preferably includes: a base board; brackets, each being disposed so as to protrude from the base board; a rotating shaft mounted through holes of the brackets; movable shaft portions, one end of the shaft portions thereof serving as worms and the other end portions thereof serving as stoppers, respectively, the worms being engageable with gears fixed on the rotating shafts; and springs, each being disposed between the stopper and the thermal head, for biasing a thermal head by a restoring force thereof.

The adjusting means preferably further includes: means for indicating a biasing force of the plurality of biasing means. The indication means may be a dial fixed to an end of the rotating shaft for indicating an amount of rotation of the rotating shaft.

The thermal printer may further comprises control means for controlling the adjusting means based on the condition of a sheet to be used.

For the purpose of preventing a recording sheet from being bent due to its failure to be separated from a ribbon even if thin paper is used, the thermal printer may further comprises: means for shifting the thermal head between first and second conditions, the thermal head being brought into pressure contact with the platen roll in the first condition, and the pressure contact between the thermal head and the platen roll being released in the second condition; means for supplying a thermal transfer ribbon; control means for controlling the shifting means so that the thermal head is brought into pressure contact with the platen roll and further controlling the supply means so that the thermal transfer ribbon is supplied when a printing is made on a recording sheet, while controlling the shifting means so that the pressure contact between the line head and the platen roll is released and further controlling the supply means so that supply of the thermal transfer ribbon is stopped when no printing is made on a recording sheet; and means for delaying a timing for stopping the ribbon supply for a predetermined time.

DETAILED DESCRIPTION OF THE PREFERRED EMBODIMENTS

A thermal printer having biasing force adjustment means of the invention will be described in detail with reference to FIG. 1.

Figure 1:
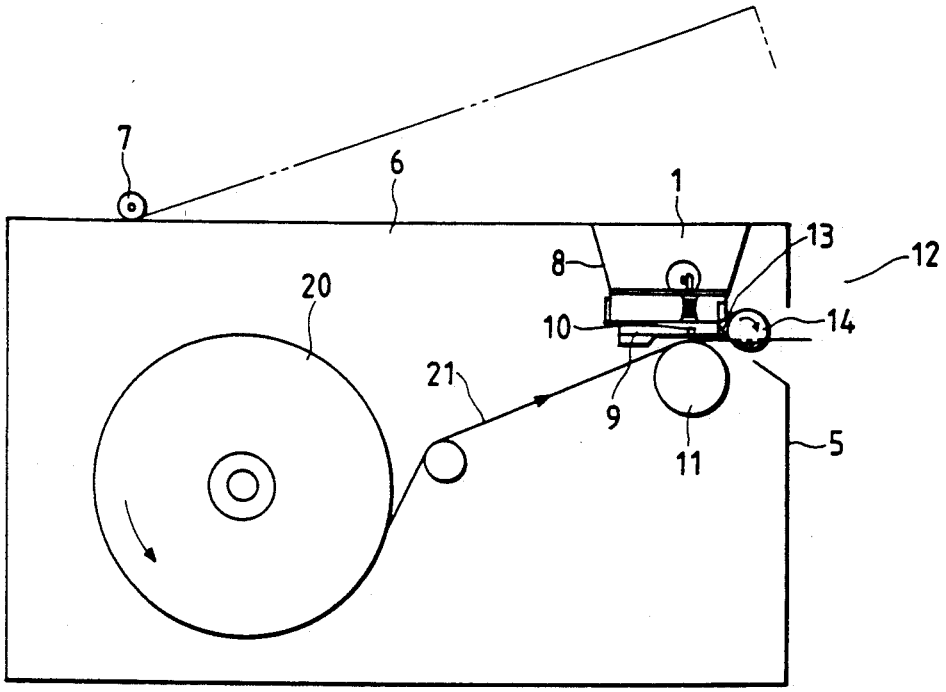
FIG. 1 is a schematic diagram showing an embodiment of a thermal printer having biasing force adjustment means of the invention.

As shown in FIG. 1, an upper cover 6 is arranged on an upper portion of a printer case 5 with a hinge 7 so as to be rotatable around the hinge, and below this upper cover is a thermal head 9 mounted through an attachment 8. A thermal head array 10 extends in a print width direction.

Below the thermal head is a platen roll 11 mounted in the case body with its rotating shaft extending in the print width direction.

A receiving blade 13 of a cutting unit 12 is screwed to a front end portion of the thermal head, while a cutting blade (rotary cutter) 14, forming a pair with the receiving blade, is mounted in the case body with its rotating shaft extending in the print width direction.

Above the thermal head is adjustment means 1 for adjusting a plurality of thermal head biasing means, which is a feature of the invention and which extends in the print width direction.

Figure 2:
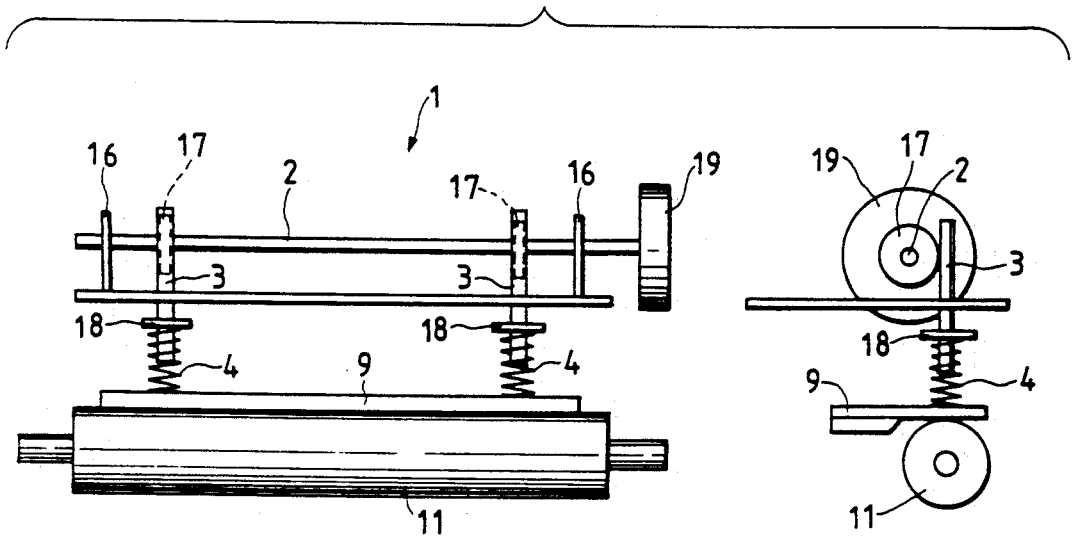
FIG. 2 is a diagram showing details of the biasing force adjustment means which is a major feature of the invention.

More specifically, as shown in FIG. 2, a rotating shaft 2 is mounted through holes of bracket portions 16 that are arranged so as to protrude from a base board 15. Two gears 17 are fixed to this rotating shaft. Movable shaft portions 3, which are, e.g., cylindrical, have one end thereof being formed into worms and the other ends serving as stoppers 18 so as to be meshed with the two gears 17, respectively. Springs 4 are provided between the stoppers and the thermal head, so that restoring forces of the springs can bias the thermal head.

As shown in FIG. 2, the right end of the rotating shaft has a dial 19 for turning the rotating shaft. The dial is so graduated as to correspond to an amount by which each movable shaft moves relative to the base board, thereby allowing the thermal head biasing force to be adjusted subtly by the graduation in accordance with the condition of a sheet to be used.

When the upper cover 6 is closed thereafter as shown by the broken line in FIG. 1, the thermal head is brought into pressure contact with the platen roll through a sheet 21 fed from a rolled sheet 20, making the printer ready to be used.

This embodiment employs a method in which the thermal head biasing force is manually adjusted by rotating the dial in accordance with the condition of a sheet to be used.

Figure 3:
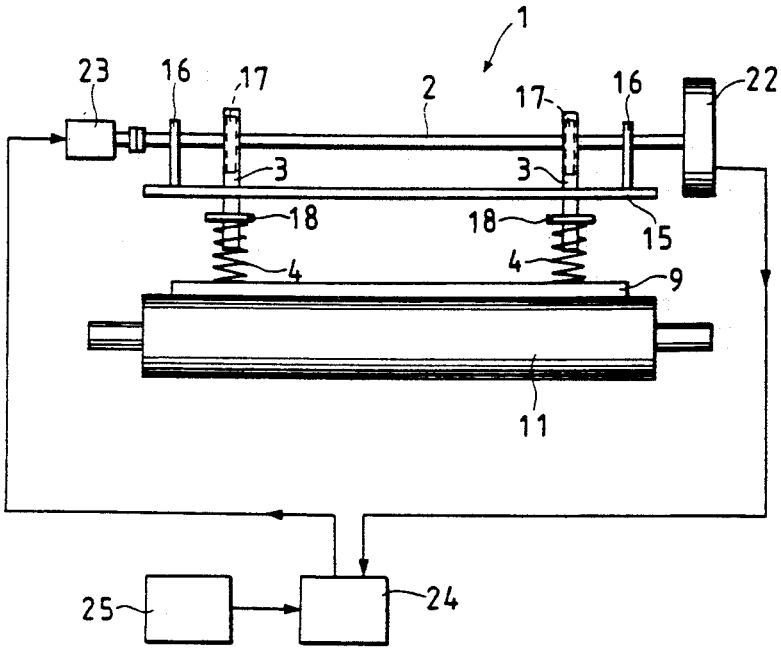
FIG. 3 is a diagram showing another embodiment of the biasing force adjustment means which is the major feature of the invention.

As shown in FIG. 3, there is a second embodiment of the invention, in which the dial shown in FIG. 2 is replaced by a rotary encoder 22 and the shaft of a pulse motor 23 is connected to the left end of the rotating shaft, and the rotary encoder and the pulse motor are connected to an adjustment section 24.

Under this construction, the position of each movable shaft relative to the base board, is translated into the thermal head biasing force for a particular type of a paper to be used, an is s set to the adjustment section from an input section 25.

If there is any difference between the set value and the actual position of the movable shafts when these two values are compared, the adjustment section can automatically adjust the direction and amount of rotation of the pulse motor. This is one of the preferred embodiments of the invention.

According to the thermal printer of the invention, the thermal head can be adjusted easily without needing any special skill.

Therefore, the thermal head biasing force can be readily and subtly in accordance with sheet conditions such as smoothness of the printing surface of thick paper and other print paper, thereby producing high-quality print.

In addition, the invention allows the adjustment to be made by the user, which dispenses with the involvement of servicemen at the user's premises, thereby significantly reducing inconvenience and the cost of servicing the printer.

An embodiment in accordance with a second aspect of the present invention is hereafter described with reference to FIGS. 4 to 7. The embodiment is directed to a mechanism for separating a ribbon from a recording sheet in a thermal line printer featuring a control system that reduces ribbon consumption.

Figure 7:
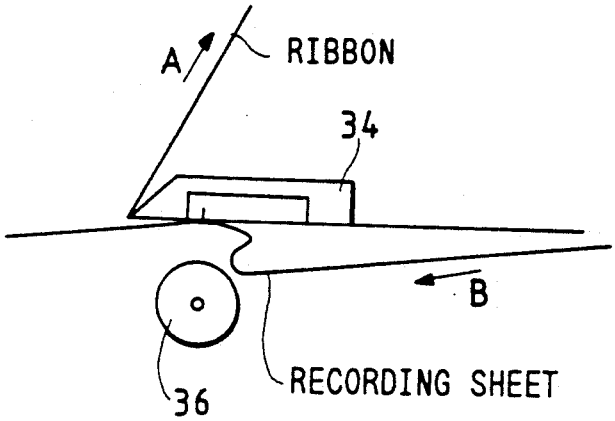
FIG. 7 is a side view of a conventional example.

The print operation of a thermal printer is such that print data developed into a dot pattern are printed on a single dot line basis. A more specific printing process of this type of printer involves the steps of increasing the temperature of a part of the head which is used for printing, fusing a part of the ribbon corresponding to the heated part of the head, and transferring a carbon portion of the ribbon onto a recording sheet. Thus, at an instance of printing, the ribbon is fused with the recording sheet, and the ribbon and recording sheet which are fused are then separated from each other by rewinding the ribbon in a direction (shown by an arrow A in FIG. 7) different from that of the recording sheet when the recording sheet is forwarded. However, if the recording sheet and the ribbon are forwarded by an equal amount at all times including when the printer is not printing, a part of the ribbon not used for printing will be wasted. Thus, a conventional thermal line printer featuring a ribbon saving control system is operated in such a manner that the ribbon is forwarded with the recording sheet only during printing. When a certain piece of print data has been printed, there is a portion at which the recording sheet and the ribbon are not separated and thus contact exists. The recording sheet and the ribbon must be separated from each other at such a portion. If a recording sheet is thick, it is rigid. Therefore, when the recording sheet is forwarded out by feed rolls, its rigidity contributes to separating itself from the ribbon. However, if a recording sheet is thin, there is no such force available in the recording sheet to separate itself from the ribbon. As a result, the recording sheet is pushed out by the feed rolls while fused with the ribbon, causing the recording sheet to bend near the ribbon as shown in FIG. 7.

In order to prevent a recording sheet from being bent due to its failure to be separated from a ribbon even if thin paper is used, the present invention further provides a device described bellow.

Figure 4:
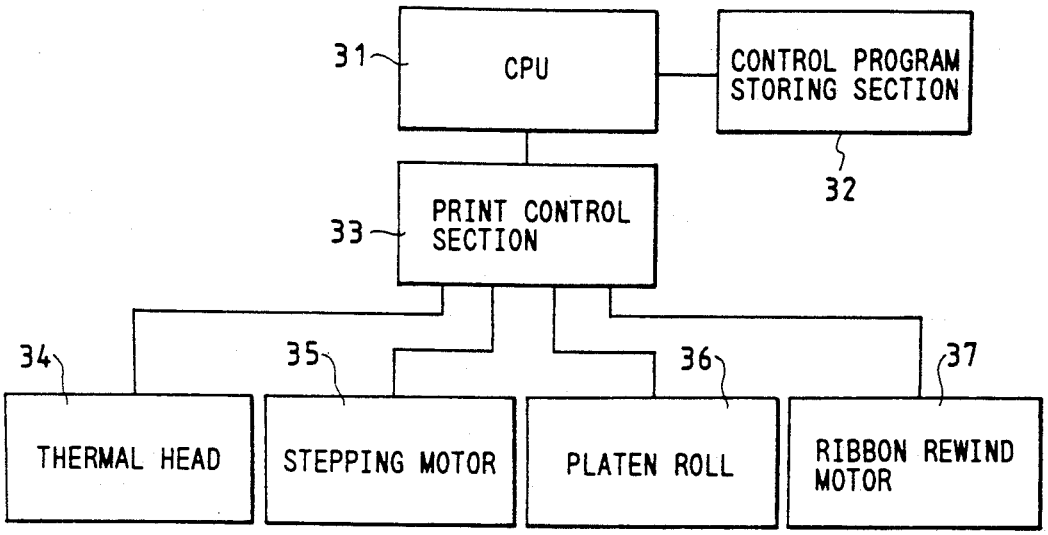
FIG. 4 is a diagram showing the configuration of an embodiment of the device in accordance with a second aspect of the present invention.
Figure 5:
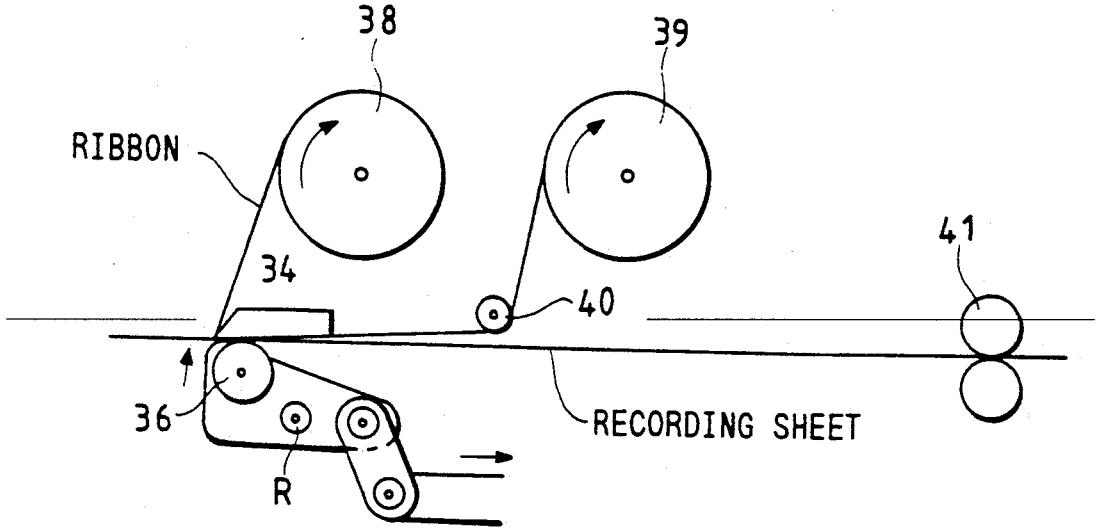
FIG. 5 is a side view of the embodiment shown in FIG. 4.
Figure 6:
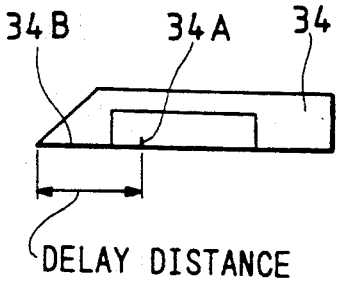
FIG. 6 is a detailed diagram of a thermal head.

FIGS. 4 and 5 show an embodiment of a device. In FIG. 4, reference numeral 31 designates a central processing unit (CPU) that controls the entire part of a printer; 32 is a control program storing section that stores programs for controlling various parts (later described) of the printer; 33 is a print control section that controls the various parts of the printer by instructions from the CPU 31 in a manner described later; 34 is a line thermal head; and 36 is a platen roll. As shown in FIG. 5, the platen roll 36 is held so as to be rotatable around a support roll axis R, and when a printing is made on a recording sheet, the platen roll 36 is driven about axis R so as to come in pressure contact with the line thermal head 34, while when no printing is made on the recording sheet, the platen roll 36 is driven about axis R so as to release the pressure contact between the thermal head 34 and the platen roll 36. Reference numeral 38 designates a ribbon rewind roll that is driven by a motor 37 (FIG. 4). This roll 38 normally rewinds the ribbon synchronously with the recording sheet while a piece of print data is being printed. Reference numeral 39 designates a ribbon supply roll; 40 is a ribbon tension roll; 41 are recording sheet feed rolls that are driven by a stepping motor 35 (FIG. 4) so as to forward the recording sheet on a single dot line basis. The ribbon rewind roll 38 stretches the ribbon from the front edge of the thermal head 34 so that the ribbon forms an obtuse angle with the recording sheet, and thereby separates the ribbon from the recording sheet. It is the CPU 31 that assumes the function of controlling the timing at which to stop the ribbon rewind drive in accordance with the thickness of the recording sheet. If a recording sheet is thin, the rewind stoppage is delayed slightly. The ribbon rewind stoppage timing may be set to a timing at which the recording sheet has completely been separated from the ribbon; e.g., a time for the recording sheet and the ribbon to travel from a print line 34A of the head to a ribbon dispenser 34B (a delay distance) as shown in FIG. 6.

The ribbon rewind roll 38 stoppage timing delay in accordance with the thickness of a recording sheet, thick or thin, may be selected either by an automatic control system based on by CPU sensing operation or a manual operation by an operator.

According to the device, the ribbon feed is delayed after printing and then stopped after separation of the recording sheet from the ribbon only in the case where thin recording sheets are used. As a result, not only the ribbon can be saved, but also the recording sheet is no longer bent because it is not being separated from the ribbon.

For a thin recording sheet that possesses no such rigidity as to separate from the ribbon, the recording sheet and the ribbon must be forcibly separated from each other by delaying a ribbon supply stoppage timing. The device postpones the ribbon supply stoppage until the ribbon and the recording sheet pass beyond a position where they adhere to each other by supplying the ribbon and not stopping the ribbon supply immediately after printing. As a result, the recording sheet and the ribbon which adhere to each other due to printing can be separated forcibly.

What is claimed is:

1. A thermal printer having a thermal head, comprising:

a plurality of biasing means, disposed in a print width direction, for biasing said thermal head onto a platen roll; and adjusting means for commonly adjusting said plurality of biasing means, the adjusting means comprising:

a base board;

brackets, each being disposed so as to protrude from said base board;

a rotating shaft mounted through holes of said brackets;

movable shafts one end thereof serving as worms and another end thereof serving as stoppers, said worms being engageable with gears fixed on said rotating shaft; and springs, each being disposed between said stoppers and said thermal head, for biasing the thermal head by a restoring force of said springs.

2. The thermal printer according to claim 1, wherein said adjusting means includes a means for indicating a biasing force of said plurality of biasing means.

3. The thermal printer according to claim 1, wherein said adjusting means further includes:

a dial fixed to an end of said rotating shaft for indicating an amount of rotation of said rotating shaft.

4. The thermal printer according to claim 1, further comprising:

control means for controlling said adjusting means based on a condition of a sheet to be used.

5. The thermal printer according to claim 1, further comprising:

means for shifting said thermal head between a first and second condition, said thermal head being brought into pressure contact with said platen roll in said first condition, and said pressure contact between said thermal head and said platen roll being released in said second condition;

means for supplying a thermal transfer ribbon;

control means for controlling said shifting means so that said thermal head is brought into pressure contact with said platen roll and further controlling said supplying means so that said thermal transfer ribbon is supplied when a printing is made on a recording sheet, while controlling said shifting means so that said pressure contact between said thermal head and said platen roll is released and further controlling said supply means so that supply of said thermal transfer ribbon is stopped when no printing is made on a recording sheet; and means for delaying a timing for stopping said ribbon supply for a predetermined time.

6. The thermal printer according to claim 5, wherein said predetermined time is determined such that said recording sheet and said thermal transfer ribbon travel to a ribbon dispenser means during said predetermined time.

* * * * *